US005919564A

United States Patent [19]

Sugaya et al.

[11] Patent Number: 5,919,564

[45] Date of Patent: Jul. 6, 1999

[54] ELASTIC POLYURETHANEUREA FIBER

[75] Inventors: Takeshi Sugaya, Moriyama; Kazuhiko Naka, Chiba, both of Japan

[73] Assignee: Asahi Kasei Kogyo Kabushiki Kaisha, Osaka

[21] Appl. No.: 08/983,477

[22] PCT Filed: Jul. 25, 1996

[86] PCT No.: PCT/JP96/02098

§ 371 Date: Jan. 21, 1998

§ 102(e) Date: Jan. 21, 1998

[87] PCT Pub. No.: WO97/05309

PCT Pub. Date: Feb. 13, 1997

[30] Foreign Application Priority Data

Jul. 25, 1995 [JP] Japan ..... 7-188831(PAT

[51] Int. Cl.[6] ..... D02G 3/00; C08G 18/10

[52] U.S. Cl. ..... 428/364; 528/52; 528/55; 528/57; 528/61; 528/65; 528/66; 528/80; 528/367; 528/422

[58] Field of Search ..... 528/61, 65, 66, 528/80, 55, 57, 52, 367, 422; 428/364

[56] References Cited

U.S. PATENT DOCUMENTS 3,384,623 5/1968 Inoue et al. ..... 528/49

5,539,037 7/1996 Iqbal ..... 524/394

FOREIGN PATENT DOCUMENTS 44-22113 9/1969 Japan .
49-10955 1/1974 Japan .
49-10956 4/1974 Japan .
49-20398 5/1974 Japan .
61-15166 4/1986 Japan .
7-166426 6/1995 Japan .

*Primary Examiner*—Samuel A. Acquah
*Attorney, Agent, or Firm*—Finnegan, Henderson, Farabow, Garrett & Dunner, L.L.P.

[57] ABSTRACT

Disclosed is a polyurethaneurea elastic fiber composed of a polyurethaneurea obtained by a reaction of a polymer diol, organic diisocyanate, bifunctional amine mainly consisting of 75% or more of ethylenediamine and a monoamine; and incorporated therein a specific alkylsulfonate or sulfate having a specific hydrocarbon groups containing carbon atoms ranging from 6 to 20. The polyurethaneurea elastic fiber can exhibit a high breaking strength and high elongation at break, and therefore, can produce a fine denier polyurethaneurea elastic fiber. The fiber can provide a converting processing of elastic fiber under a high draft and at a higher processing speed.

2 Claims, No Drawings

ELASTIC POLYURETHANEUREA FIBER

FIELD OF THE INVENTION

This invention relates to a polyurethaneurea elastic fiber exhibiting a high breaking strength and, preferably, a polyurethaneurea elastic fiber having a high breaking strength together with a high elongation at break.

BACKGROUND ART

Polyurethaneurea elastic fiber exhibits, on the basis of its unique elastic properties, an excellent elastic stretch power, a high elongation and high elastic recovery, and has been widely used in versatile application fields such articles of clothing and in products for industrial use. In the field of pantyhose, in which polyurethaneurea elastic fiber is often used, an improvement in the transparency of a polyurethaneurea elastic fiber is required. To satisfy this requirement, production of fine denier fiber is required. Moreover, in order to improve the productivity, in relation to a converting process, high-draft processing and high-speed processing are required. To satisfy the above-mentioned requirements, it is necessary that the breaking strength, preferably the breaking strength together with the elongation at break, of a polyurethaneurea elastic fiber should be increased.

A polyurethaneurea solution used in the manufacture of polyurethaneurea elastic fiber tends to give rise to occurrences of partial gel (or gelation) and abrupt and intense increase in viscosity due to the cohesion of hard segments in the polymer whereby the shaping process becomes unstable. Polyurethaneurea elastic fiber prepared from such solution cannot exhibit either a high breaking strength or a high elongation at break.

There have been several attempts to improve polyurethaneurea fiber in its breaking strength and its elongation at break. In connection with a technology for removing the instability of a spinning dope, which is caused by the cohesion of hard segments in the polyurethaneurea solution, there are known, for instance, Japanese Examined Patent Publication (Kokoku) No.44-22113 and No. 45-10956.

Japanese Examined Patent Publication (Kokoku) No. 44-22113 describes an improvement in spinning dope in which the stability of polyurethaneurea solution is increased by reacting an intermediate polymer (prepolymer) with isocyanate terminal groups at both ends with a small amount of monofunctional alcohol and successively reacting the mixture with a bifunctional amine to form a chain extended polymer, in order to improve stability of the polyurethaneurea solution and the spinnability of the spinning dope. With an improvement in spinnability, the resultant elastic fiber is improved in its breaking strength and elongation at break. However, it is to be noted that, since the breaking strength described in the publication is 1 g/d at most, the improvement in the strength is not large. In the description of the publication, there is stated, "It is well known that a compound such as a metal salt, an alkali, an amine or the like prompts a formation of gelated reaction product in a urethane reaction." This statement discloses the necessity of the removal of these compounds.

Further, Japanese Examined Patent Publication (Kokoku) No. 45-10956 describes that objectives pertaining mainly to the prevention of gel forming and the stabilization of a polyurethaneurea solution are achieved by a method for chain extension of a prepolymer solution in which a prescribed amount of a previously added monofunctional amine is reacted before the chain extension with the addition of a bifunctional amine is carried out. Further, the method improves the strength of the fiber by promoting suitable formation of crosslinking or branching by side-reaction other than the chain extension reaction at the time when a monofunctional amine is reacted. The resultant dope is stable; however, the fiber is not necessarily satisfactory because the resultant fiber exhibits a strength of 1.28 g/d and an elongation of 580%. It is disclosed that the improvement effect on tensile properties seems to be relatively great in contrast to the comparative gelated dope. However in general, a fiber prepared from a dope involving a side-reaction exhibits an improved strength and modulus, however the elongation is rather deteriorated.

A polyurethaneurea elastic fiber obtained by the above known technology, cannot reach either the required breaking strength or the required elongation at break.

Japanese Unexamined Patent Publication (Kokai) No. 1-166426 describes a technology for improving an antistatic property of a polyurethaneurea elastic fiber in the course of converting by incorporating a metal salt of sulfonic acid therein where propylenediamine (1,2-diaminopropane) is solely used as a bifunctional amine. The known disclosure does not suggest the effect of the sulfonate additive on the material properties of polyurethaneurea elastic fiber such as strength, elongation, and the like.

According to a knowledge attained by the present inventors, a polyurethaneurea making use of 1,2-diaminopropane as a bifunctional amine rather loses its strength when the sulfonate is added.

DISCLOSURE OF THE INVENTION

The object of the invention is to provide a polyurethaneurea elastic fiber exhibiting a high breaking strength and, preferably, a high breaking strength together with an improved elongation at break.

It has been found by the inventors that a polyurethaneurea elastic fiber is improved in breaking strength and, furthermore, an elongation at break when a specific sulfonate or sulfate is incorporated in a polyurethaneurea elastic fiber in which a specific ratio of an ethylenediamine is used as a bifunctional amine. The present invention is achieved on the basis of the above-mentioned knowledge.

That is, the invention is a polyurethaneurea elastic fiber comprising: an polyurethaneurea obtained by carrying out a reaction of a polymer diol, an organic diisocyanate, a bifunctional amine mainly consisting of ethylenediamine and a monofunctional amine; and incorporated therein a sulfonate or sulfate having a hydrocarbon group containing at least 6 to 20 carbon atoms.

The polyurethaneurea elastic fiber according to the present invention exhibits a high breaking strength and, in a preferred embodiment, a high breaking strength together with a high elongation at break.

A polyurethaneurea elastic fiber of the invention can be produced, for example, by a method as follows:

- a polymer diol such as a hydroxy groups-terminated polyether diol or a polyester diol is reacted with an excess molar amount of an organic diisocyanate compound to synthesize an intermediate polymer fully terminated with isocyanate groups; then,
- the intermediate polymer is reacted with a bifunctional amine consisting of 75 mole % or more of ethylenediamine and a monofunctional amine to produce a polyurethaneurea; and
- a solution of the polymer is spun to produce a polyurethaneurea elastic fiber.

Besides the method mentioned above, other methods for producing a polyurethaneurea elastic fiber, which can be optionally employed, include a method in which spinning is carried out while the above mentioned intermediate polymer is reacted with a compound of a bifunctional amine with the amino groups blocked, for example, by ketone.

The above-mentioned specific sulfonate or sulfate can be incorporated by adding a prescribed amount of the additive either to the polyurethaneurea solution in its preparation stage, or to the spinning dope of the polymer before spinning.

Polymer diols constituting a polyurethaneurea elastic fiber include a polymer diol such as homopolymer or copolymer obtained by polymerizing a monomer which is capable of ring opening polymerization, for example, ethylene oxide, propylene oxide, tetrahydrofuran, oxetane and the like and a copolymer obtained from a combination of a monomeric compound capable of ring opening polymerization with a bifunctional hydroxyl group-containing compound, for example, polyether diol such as a copolymer of tetrahydrofuran with neopentyl glycol and others; a polyester diol which can be obtained from a combination of at least one kind of dicarboxylic acid such as sebacic acid, maleic acid, itaconic acid, adipic acid, malonic acid and the like with at least one kind of diol such as ethylene glycol, propylene glycol, 1,4-butane diol, 2,3-butane diol, hexamethylene glycol, diethylene glycol, neopentyl glycol and the like; a polycarbonate diol made from linear or branched alkylene glycols containing 2 to 10 carbon atoms; those homo-polymers or copolymers such as polycarbonate diol, polyesterether diol, polyethercarbonate diol, polyestercarbonate diol and the like. The number average molecular weight of a polymer diol ranges from 500 to 10,000, preferably from 1,000 to 3,000.

When a polyurethaneurea fiber is produced via an intermediate polymer with its both terminal end groups fully isocyanated, the polyurethane is synthesized by reacting the above-mentioned polymer diol with an excess molar amount of an organic diisocyante. Examples of an organic diisocyanate include diphenylmethane diisocyanate, toluene diisocyanate, cyclohexylene diisocyanate, m- and p-phenylene diisocyanate, m- and p-xylylene diisocyanate, tetrachloro-m- and p-xylylene diisocyanate, hexamethylene diisocyanate and the like. Diphenylmethane diisocyanate which contains a benzene ring is preferred.

In an example of a representative method for producing a polyurethaneurea, after synthesis of an intermediate polymer having terminal isocyanate groups at both ends, the intermediate polymer is dissolved in an inert organic solvent, and then chain-extended by means of a bifunctional amine while a monofunctional amine is added to adjust the molecular weight of a resultant polymer by means of a termination reaction.

The bifunctional amine composing the polyurethaneurea of the present invention consists of 75 mole % or more of ethylenediamine.

The bifunctional amine and the organic diisocyanate constitute a urea portion and regulate the structure of the hard segments. As in the case of ethylenediamine where the two amino groups are narrowly spaced and where no group having steric hindrance exists near the amino groups, the polyurethaneurea attains the highest level of heat resistance because the hydrogen bond force of the hard segments reaches a maximum. On the other hand, it is possible that the polymer tends to be gelated since the cohesiveness is much increased. For the reasons set forth above, a remarkable effect can be obtained when the invention is applied to a polyurethaneurea of which the cohesiveness is naturally great.

In the case where the use is made of 1,2-diaminopropane (1,2-propylenediamine) as disclosed in the aforesaid Japanese Unexamined Patent Publication (Kokai) No. 7-166426, it has been observed that no improvement in strength is effected even if the sulfate is incorporated in the polymer of which the cohesiveness of hard segment is basically weak, because the methyl group, a functional group having steric hindrance, is introduced into the molecule.

Examples of a bifunctional amine which can be mixed with ethylenediamine include 1,2-propylenediamine, hexamethylenediamine, trimethylenediamine, hydrazine, 1,4-xylylenedlamine, 1,4-diaminocyclohexane, 1,3-diaminocyclohexane, N,N'-(methylene di-4,1-phenylene) bis [2-(ethylamino)-urea] and the like.

Examples of a monofunctional amine concurrently used are diethylamine, dimethylamine, methylethylamine, dibutylamine, diisopropylamine, methylisopropylamine, methyl-n-butylamine and the like.

As an inert organic solvent used for the urethaneuyrea solution, by way of examples, dimetylformamide, dimethylacetamide and dimethylsulfoxide and the like can be enumerated.

The sulfonates which are incorporated in the polyurethaneurea as the additive are the compounds represented by the following general formulae [I]–[III]:

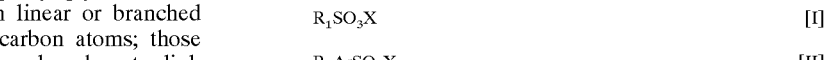

$$R_1SO_3X \quad [I]$$

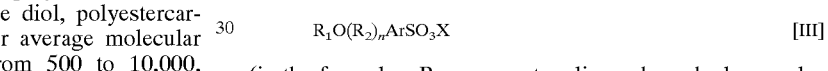

$$R_1ArSO_3X \quad [II]$$

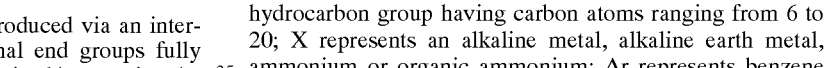

$$R_1O(R_2)_nArSO_3X \quad [III]$$

(in the formulae, $R_1$ represents a linear, branched or cyclohydrocarbon group having carbon atoms ranging from 6 to 20; X represents an alkaline metal, alkaline earth metal, ammonium or organic ammonium; Ar represents benzene nucleus; $R_2$ represents ethylene oxide and/or propylene oxide; and n represents an integer of from 1 to 10.)

The sulfates compound which are incorporated in the polyurethaneurea as the additive are the compounds represented by the following general formulae [IV]–[V]:

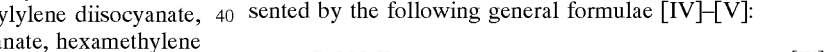

$$R_1OSO_3X \quad [IV]$$

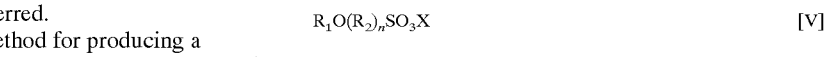

$$R_1O(R_2)_nSO_3X \quad [V]$$

(in the formulae, $R_1$ represents a linear, branched or cyclohydrocarbon group having carbon atoms ranging from 6 to 20; X represents an alkaline metal, alkaline earth metal, ammonium or organic ammonium; Ar represents benzene nucleus; $R_2$ represents ethylene oxide and/or propylene oxide; and n represents an integer of from 1 to 10).

In the light of the end-use properties of a polyurethaneurea elastic fiber and textile processing performance of the elastic fiber, a preferred compound is one as represented by formula [I] or [IV].

In the compounds as represented by general formulae [I]–[V], examples of a linear, branched or cyclic hydrocarbon group include n-hexyl, isohexyl, n-octyl, iso-octyl, n-decyl, isodecyl, n-lauryl, isolaulyl, n-myristyl, isomyristyl, n-cetyl, isocetyl, n-stearyl, isostearyl and the like. As a side chain introduced in the above-mentioned hydrocarbon group, the introduction of one or a few nonionic functional groups such as hydroxyl group, halogen group is justifiable.

When number of carbon atoms contained in a hydrocarbon group is 5 or less, these compounds are likely, for some reason related to the composition of the copolymer and/or the spinning conditions, to bleed out over the surface of yarn, and the resulting yarn may create an inconvenience owing to occurrence of tailings during a converting processing such as weaving and knitting. When the number of carbon atoms exceeds 21, the compounds decrease in their solubility in the solvent making up a polyurethaneurea spinning dope whereby the compounds may lack a uniform dispersion in a yarn; hence an improvement in the tensile properties cannot be ensured.

As alkaline metal or alkaline earth metal, lithium, sodium, potassium, magnesium, calcium and the like can be used.

The organic ammonium is an organic ammonium composed of an organic amine compound represented by the formula [VI] or organic ammonium composed of a basic nitrogen-containing heterocyclic compound.

$$NH_n(R_3)_{4-n} \quad [VI]$$

(in the formulae, $R_3$ represents a linear, branched or cyclic (aromatic, alicyclic) hydrocarbon group or hydroxyhydrocarbon group having carbon atoms ranging from 1 to 18 and n represents an integer of from 1 to 14.)

Examples of the amine are enumerated as follows: monomethyl amine, dimethylamine, trimethyl amine, monoethylamine, diethylamine, triethylamine, monoethanolamine, diethanolamine, triethanolamine, monopropylamine, dipropylamine, tripropylamine, monopropanolamine, dipropanolamine, tripropanolamine, monobutylamine, dibutylamine, tributylamine, monobutanolamine, dibutanolamine, tributanolamine, monooctylamine, dioctylamine, trioctylamine, monooctanolamine, dioctanolamine, trioctanolamine, monophenylamine, diphenylamine, triphenylamine, monocyclohexylamine, dicyclohexylamine, tricyclohexylamine, monolaurylamine, dilaurylamine, monostearylamine, distearylamine and the like. The basic nitrogen-containing heterocyclic compounds include piperidine, pyrrole, pyridine, 1,5-diazabicyclo [5. 4. 0] undecene-5 and the like.

A polyurethaneurea elastic fiber incorporated with sulfonate or sulfate in which X is alkaline metal or alkaline earth metal exhibits a high breaking strength, althouah much increased elongation at break is not observed.

A polyurethaneurea elastic fiber incorporated with sulfonate or sulfate in which X is an ammonium or an organic ammonium is especially preferable because the elastic fiber exhibits a high breaking strength together with a high elongation at break.

As to the reason why such high breaking strength is attainable, it may be postulated that either a uniform domain of finely dispersed hard segments is formed by the occurrence of an disordered intramolecular or a intermolecular hydrogen bond within the hard segment unit due to the incorporation of a sulfonate or sulfate additive having a strong ionic functional group such as sulfonic or sulfonic group, or that the cohesion of energetically unstable hard segments is suppressed due to the reduction of surface energy of hard segments which results from the coordination of the sulfonate or sulfate near the interface between the hard and soft segments so that the cohesion structure of large and uniform-sized hard segments is not present in the yarn during spinning.

A content of sulfonate or sulfate suitable for the above conditions is from 0.05 to 5.0 parts by weight, preferably 0.1 to 3.0 parts by weight, more preferably 0.1 to 1.0 parts by weight in 100 parts by weight of a polyurethaneurea. When the content is less than 0.05 parts by weight, the obtained elastic fiber cannot exhibit a high breaking strength. When the content exceeds 5.0 parts by weight, a remarkable increase in breaking strength of the obtained elastic fiber cannot be observed, and the content is not preferable because a part of the incorporated salt bleeds out over the surface of the yarn so that the processability of the yarn tends to be deteriorated.

It is allowable that the polyurethaneurea elastic fiber incorporated with the above-mentioned salt addItive is compounded further with a stabilizing agent such as a known anti-oxidant, a discoloration preventive agent, an ultraviolet absorbing agent and the like, such additives as pigments like titanium oxide, mildewproofing agent and the like and fillers. Further a finish oil and lubricant such as metal stearate and the like can be applied to the fiber. Kind of finish oil is not limitative. However, preferred finish oils are dimethylpolysiloxane, a modified polysiloxane with an introduction of amino group, vinyl group, epoxy group and the like and a mineral oil.

Constituted as mentioned above, the polyurethaneurea elastic fiber of the invention exhibits an increased breaking strength as compared with a known polyurethaneurea elastic fiber, and preferably a breaking strength (tenacity) of 1.5 g/d, more preferably 1.75 g/d (for a fine yarn having a thickness of about 20 denier); nevertheless, there is no deterioration of elongation at break with this fiber; the fiber exhibits an elongation of 600% or more, even 650% or more.

BEST MODE FOR CARRYING OUT THE INVENTION

The invention is explained in more detail by way of the following Examples. These explanations, however, are not made to limit the scope of the invention.

The basic physical properties (breaking strength and elongation at break) were measured at 20° C. under relative humidity 65% using a tensile tester (Type UTM-111-100 available from Toyo Boldwin Corp.). The measurement was carried out by setting a test yarn of which the initial length was set 50 mm, and followed by stretching the test yarn at an elongation speed of 500 mm/min. until it broke to obtain the breaking strength (unit: g) and the elongation at break (the elongation to an original length, unit: %).

EXAMPLE 1

1,000 parts by weight of a polytetramethylene glycol (hereinafter called PTMG) having a number average molecular weight of 1,800 and 220 parts by weight of 4,4'-diphenylmethane diisocyanate (hereinafter called MDI) were reacted at 65° C. in a nitrogen atmosphere for one hour while stirring the reactant to obtain an isocyanate-terminated intermediate polymer, and then a dried DMAc was added to a concentration of 60%.

Then, a DMAc solution containing 18.3 parts by weight of ethylenediamine (hereinafter called EDA) and 3.4 parts by weight of diethylamine (hereinafter called DEA) was added to the intermediate polymer under vigorous agitation to obtain a polyurethaneurea spinning dope having a concentration of about 35% by weight.

To the above-mentioned spinning dope was added 0.5 parts by weight of sodium lauryl sulfate as a sulfonate or sulfate compound (1) on 100 parts by weight of the polymer. Subsequently, based on the polymeric solid content, 1% by weight of a condensation-polymerizate of p-cresol, dicyclopentadiene and isobutylene having a molecular weight of about 2300 as an anti-oxidant and 0.5% by weight of 2-(2-hydroxy-3,5-bis (α,α-dimethylbenzyl) phenyl)-2H-benzotriazole as an ultraviolet absorbing agent were added to prepare a spinning composition having a concentration of about 35% by weight.

The solution was fed to a dry spinning machine and was spun at a winding speed of 800 m/min. to obtain a polyurethaneurea elastic fiber having a thickness of 20-denier/2-filament. The physical properties of the yarn are given in Table 1.

EXAMPLES 2–9

Spinning dopes were prepared in accordance with the method as in Example 1 except that the following sulfonate or sulfate compounds (2)–(8) in place of compound (1) were added to the above-mentioned polyurethaneurea spinning dope.

Sodium hexyl sulfate (2)

Sodium cetyl sulfate (3)

Sodium stearyl sulfate (4)

Sodium laurylpolyoxyethylene (6) sulfate 5)

Sodium laurylpolyoxyethylene (13) sulfate (6)

Sodium lauryl benzene sulfonate (7)

Sodium 1,3,5,7-tetramethyl octyl benzene sulfonate (8)

The spinning dopes were dry-spun by the same method as that in Example 1 using a dry spinning machine to obtain a polyurethaneurea elastic fiber having a thickness of 20-denier/2-filament. The physical properties of the yarn are given in Table 1.

COMPARATIVE EXAMPLE 1

Except that the addition of the above-mentioned sulfonate or sulfate compound is omitted, a polyurethaneurea elastic fiber was prepared by the same method as that in Example 1. The spinning dope was dry-spun using a dry spinning machine and a polyurethaneurea elastic fiber having a thickness of 20-denier/2-filament was obtained. The physical properties of the obtained yarn are given in Table 1.

TABLE 1

| | | Incorporated amount | Physical properties of as spun yarn | |
|---|---|---|---|---|
| Unit | Compound | Part by weight based on polymer | Breaking strength g | Elongation at break % |
| Example 1 | 1 | 0.500 | 43.0 | 630 |
| Example 2 | 2 | 0.333 | 43.7 | 629 |
| Example 3 | 3 | 0.597 | 36.9 | 641 |
| Example 4 | 4 | 0.646 | 33.4 | 656 |
| Example 5 | 5 | 0.958 | 44.5 | 604 |
| Example 6 | 6 | 1.493 | 44.4 | 628 |
| Example 7 | 7 | 0.604 | 41.8 | 644 |
| Example 8 | 8 | 0.604 | 40.3 | 656 |
| Comparative Example 1 | — | — | 27.5 | 613 |

In Examples 2–8, as shown in Table 1, the compounds were added so that the molar value of the respective compounds was equal to that of compound (1) in Example 1. In comparison with Comparative Example 1, the polyurethaneurea elastic fibers prepared by dry spinning a spinning dope incorporated with a metallic sulfonate or sulfate of a metal like sodium having a small ionic radius as the cation exhibits a high breaking strength even though the fibers do not exhibit a remarkable increase in elongation at break.

EXAMPLES 9–12

In accordance with the method in Example 1, the above-mentioned polyurethaneurea spinning dopes were incorporated therein with the following sulfonate or sulfate compounds (9)–(32) to prepare a spinning dope.

1,5-Diazabicyclo [5. 4. 0] undecene-5 lauryl sulfate (9)

Pyridinium lauryl sulfate (10)

Monoethylamine lauryl sulfate (11)

Diethylamine lauryl sulfate (12)

Triethylamine lauryl sulfate (13)

Monoethanolamine lauryl sulfate (14)

Diethanolamine lauryl sulfate (15)

Triethanolamine octyl sulfate (16)

Triethanolamine lauryl sulfate (17)

Triethanolamine cetyl sulfate (18)

Triethanolamine stearyl sulfate (19)

Triethylamine 2-propylpentyl sulfate (20)

Triethylamine 2-hexyldecanyl sulfate (21)

Triethanolamine 2-hexyldecanyl sulfate (22)

Triethanolamine 2-heptylundecanyl sulfate (23)

Triethylamine 1,3,5,7-tetramethyloctyl sulfate (24)

Triethanolamine 1,3,5,7-tetramethyloctyl sulfate (25)

Triethylamine 1,3,5,7-tetramethyloctyl benzene sulfonate (26)

Triethanolamine 1,3,5,7-tetramethyloctyl benzene sulfonate (27)

Triethanolamine myristylpolyoxyethylene (5) sulfate (28)

Triethanolamine cetylpolyoxyethylene (5) sulfate (29)

Triethanolamine stearylpolyoxyethylene (5) sulfate (30)

Triethanolamine 2-heptylundecanyl-polyoxyethlene (5) sulfate (31)

Triethylamine 1,3,5,7-tetramethyloctylpolyoxyethylene (5)

benzene sulfonate (32)

Using a dry spinning machine, the spinning dopes were spun to obtain polyurethaneurea elastic fiber having a thickness of 20-denier/2-filament. The physical properties of the obtained yarns are given in Table 2.

TABLE 2

| | | Incorporated amount | Physical properties of as spun yarn | |
|---|---|---|---|---|
| Unit | Compound | Part by weight based on polymer | Breaking strength g | Elongation at break % |
| Example 9 | 9 | 0.724 | 41.5 | 626 |
| Example 10 | 10 | 0.764 | 37.5 | 635 |
| Example 11 | 11 | 0.540 | 35.0 | 704 |
| Example 12 | 12 | 0.616 | 37.5 | 696 |
| Example 13 | 13 | 0.637 | 37.4 | 702 |
| Example 14 | 14 | 0.568 | 36.6 | 714 |
| Example 15 | 15 | 0.644 | 35.6 | 720 |
| Example 16 | 16 | 0.720 | 40.5 | 694 |
| Example 17 | 17 | 0.630 | 39.4 | 697 |
| Example 18 | 18 | 0.818 | 37.2 | 655 |
| Example 19 | 19 | 0.969 | 36.0 | 645 |
| Example 20 | 20 | 0.540 | 38.2 | 652 |
| Example 21 | 21 | 0.540 | 36.1 | 677 |
| Example 22 | 22 | 0.818 | 35.6 | 710 |
| Example 23 | 23 | 0.968 | 36.9 | 727 |
| Example 24 | 24 | 0.637 | 36.7 | 691 |
| Example 25 | 25 | 0.720 | 37.8 | 710 |
| Example 26 | 26 | 0.741 | 37.0 | 691 |
| Example 27 | 27 | 0.720 | 37.9 | 728 |
| Example 28 | 28 | 1.151 | 34.6 | 680 |
| Example 29 | 29 | 1.200 | 33.5 | 675 |
| Example 30 | 30 | 1.248 | 31.8 | 669 |
| Example 31 | 31 | 1.248 | 35.1 | 689 |

TABLE 2-continued

| Unit | Compound | Incorporated amount Part by weight based on polymer | Physical properties of as spun yarn Breaking strength g | Elongation at break % |
|---|---|---|---|---|
| Example 32 | 32 | 1.151 | 37.2 | 703 |
| Comparative Example 1 | — | — | 27.5 | 613 |

In Examples 9–32 tabulated in Table 2, the respective compounds are incorporated in a molar amount equal to the molar amount of the compound (1) given in Table 1. In comparison with Comparative Example 1, the elastic fibers obtained by dry spinning the dope incorporating therein a sulfate or sulfonate having an organic base such as triethanolamine and triethylamine as a cation and having a sulfonic or sulfuric as an acidic functional group exhibit a high breaking strength together with an increased elongation at break. In common with the case where the cation is sodium, the elastic fiber obtained by incorporating a sulfate having an ultra basic group such as 1,5-diazabicyclo [5.4.0] undecene-5 in Example 9 produces a high breaking strength, though it does not exhibit a remarkable increase in elongation at break.

In the case of a compound in which the cation is of a metallic nature as in the case of Example 1–8 in shown in Table 1, a high breaking strength is attained, while a high elongation at break cannot be obtained.

In view of the results obtained from the compounds of Examples 9–32, it can be seen that there is a difference in the observable effect between a metallic salt and an ammonium salt even though the acidic groups are common. This indicates that the mechanism of their actions on hard segments or hydrogen bonds are not at all alike.

EXAMPLES 33–37

In accordance with the method of Example 1, the above-mentioned polyurethaneurea spinning dope was prepared by incorporating therein 0.072–4.320 parts by weight of the compound (25) (triethanolamine 1,3,5,7-tetramethyloctyl sulfate) on 100 parts by weight of the polymer, and the spinning dope was heat-shaped to obtain a polyurethaneurea elastic fiber having a thickness of 20-denier/2-filament. The results on the obtained yarns are shown in Table 3.

COMPARATIVE EXAMPLE 2

Except that the incorporation of a sulfonate or sulfate is omitted, a polyurethaneurea spinning dope was prepared by the same method as that in Example 1. The spinning dopes were dry spun by a dry spinning machine to produce a polyurethaneurea elastic fiber having a thickness of 20-deniers/2-filament. The results on the obtained yarns are given in Table 3.

TABLE 3

| Unit | Incorporated amount Part by weight based on polymer | Physical properties of as spun yarn Breaking strength g | Elongation at break % |
|---|---|---|---|
| Example 33 | 0.072 | 30.1 | 679 |
| Example 34 | 0.216 | 32.3 | 694 |
| Example 35 | 0.720 | 35.5 | 711 |
| Example 36 | 2.160 | 31.9 | 670 |
| Example 37 | 4.320 | 30.2 | 667 |
| Comparative Example 2 | — | 27.4 | 613 |

As shown in Table 3, the elastic fibers prepared by dry spinning polyurethaneurea spinning dopes in which triethanolamine 1,3,5,7-tetramethyloctyl sulfate was incorporated in an amount of 4.32 or less, preferably 0.072 to 4.3 parts by weight on 100 parts by weight of the polymer, exhibit a high breaking strength. The maximum improvement in the breaking strength is effected by an incorporation of about 0.72 parts by weight of the additive. An incorporation of 2.16 parts by weight or more does not effect any marked increase in breaking strength.

COMPARATIVE EXAMPLE 3

1,000 parts by weight of PTMG having a number average molecular weight of 2,000 and 250 parts by weight of MDI were reacted at 65° C. in a nitrogen atmosphere for one hour, while the reactants were being stirred to obtain a isocyanate-terminated intermediate polymer, and then dried DMAc was added to prepare a solution having a concentration of 60%.

Then, a DMAc solution containing 35.3 parts by weight of 1,2-propylenediamine (hereinafter called PDA) and 3.3 parts by weight of DEA was added to the intermediate polymer under vigorous agitation to obtain a polyurethaneurea spinning dope having a concentration of 33% by weight of the polymer. Into the above-mentioned polyurethaneurea spinning dope, only 1.0 parts by weight of sodium pentadecyl sulfonate based on 100 parts by weight of the polymer was incorporated.

Based on the polymeric solid content, 1% by weight of a condensation-polymerizate of p-cresol, dicyclopentadiene and isobutylene having a molecular weight of 2,300 as an anti-oxidant and 0.5% by weight of 2-(2-hydroxy-3, 5-bis ($\alpha$,$\alpha$-dimethylbenzyl)phenyl)2H-benzotriazole as an ultraviolet absorbing agent were further incorporated to obtain a spinning dope composition having a concentration of about 33% by weight.

The spinning dope was fed to a dry spinning machine, and was spun at a winding speed of 800 m/min. to obtain a polyurethaneurea elastic fiber having a thickness of 20-denier/2-filament. The breaking strength of the obtained yarn was 28.1 g and the elongation at break was 468%.

COMPARATIVE EXAMPLE 4

In accordance with the method in Comparative Example 3, except that sodium pentadecyl sulfonate was incorporated, a polyurethaneurea elastic fiber having a thickness of 20-denier/2-filament was prepared. The breaking strength of the yarn obtained was 34.7 g; the elongation at break was, 507%.

As seen from the comparison of Comparative Example 4 with Comparative Example 3 in connection with the physical properties, even when the sulfonate is incorporated, no noticeable effect is obtained and the physical properties are rather deteriorated. The reason for this is PDA, a bifunctional amine used as a chain extender; it is conceived that the PDA, a diamine which is used as a chain extender, makes the occurrence of hydrogen bond lower by the side chain methyl group of PDA acting as a steric hindrance at the time of formation of hard segments whereby the cohesiveness of hard segment is caused to be lowered. Since a hard segment of PDA has a low cohesiveness by nature, therefore, even when such a substance as sulfonate, that makes the cohesiveness lower, is brought to act thereon, breaking strength could be far from being developed and could rather be deteriorated because the cohesiveness is rather excessively lowered.

EXAMPLE 38

1,000 parts by weight of PTMG, having a number average molecular weight of 1,800, and 220 parts by weight of MDI were reacted at 65° C. in a nitrogen atmosphere under stirring for 1 hour to produce an intermediate polymer, and dried DMAc was subsequently added to prepare a solution having a concentration of 60%. Then, a DMAc solution containing 16.3 parts by weight of EDA, 2.2 parts by weight of PDA and 3.4 parts by weight of DEA was added to the intermediate polymer under vigorous agitation to prepare a polyurethaneurea spinning dope having a concentration of about 35% by weight. The mix molar ratio of EDA:PDA was 90:10.

To the above-mentioned dope, only triethanolamine lauryl sulfate was further incorporated in an amount of 0.4 parts by weight on 100 parts by weight of the polymer.

Further, based on the weight of the polymeric solid content, 1% by weight of a condensation-polymerizate of p-cresol, dicyclopentadiene and isobutylene having a molecular weight of 2300 as an antioxidant and 0.5% by weight of 2-(2-hydroxy-3,5-bis(α,α-dimethylbenzyl) phenyl)-2H-benzotriazole as an ultraviolet absorbing agent were further incorporated to obtain a spinning dope composition having a concentration of about 38% by weight.

The spinning dope was fed to a dry spinning machine and was spun at a winding speed of 800 m/min. to obtain a polyurethaneurea elastic fiber having a thickness of 20denier/2-filament. The breaking strength and elongation at break were 32.1 g and 638% respectively.

COMPARATIVE EXAMPLE 5

Except that ethanolamine lauryl sulfate used in Example 38 was incorporated, a polyurethaneurea elastic fiber having a thickness of 20-denier/2-filament was prepared according to the same method as that of Example 38. The breaking strength and elongation at break were 29.8 g and 607% respectively. When the physical properties of the yarn obtained in Example 38 are compared with those of the fiber obtained in Comparative Example 5, it is seen that the breaking strength and elongation at break are improved with the incorporation of triethanolamine lauryl sulfate, differing from the cases of Comparative Examples 3 and 4. The reason for this difference is that the urea portion having a high cohesiveness is formed at the time of formation of the hard segment in the case where a bifunctional amine used as chain extender consisting mainly of EDA. Reduction of the cohesiveness of all the hard segments cannot be effected by a mix containing about 10 mole % even with the use of PDA having a methyl group side chain which effects steric hindrance. The reason for the attainment of the improvement in physical properties of the obtained yarn is that such sulfate compound enabling to lower the cohesiveness as used in the present invention is brought to act on a copolymeric polyurethaneurea having hard segments of which the high cohesiveness is inherent.

INDUSTRIAL APPLICABILITY

The polyurethaneurea elastic fiber of the invention exhibits an exceedingly high breaking strength and together with a high elongation at break and, for this reason, can provide a fine denier polyurethaneurea elastic fiber with an advantages in practical use.

With the characteristic high elongation at break, the polyurethaneurea elastic fiber of the invention can be processed under high draft conditions in the production of covered yarns and core yarns. Further, the fiber has an advantage to the effect that knitted and woven fabric of elastic fibers can be produced at a higher processing speed.

We claim:

1. A polyurethaneurea elastic fiber comprising: a polyurethaneurea obtained by reacting a polymer diol, organic diisocyanate, bifunctional amine and monoamine; and incorporated therein at least one compound selected from the group consisting of a sulfonate and sulfate represented by the following general formulae in an amount of from 0.05 to 5.0 parts by weight based on 100 parts by weight of the polyurethaneurea in which the bifunctional amine consists of 75 mole % or more of ethylenediamine;

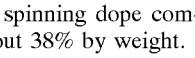

$$R_1SO_3X \quad [I]$$

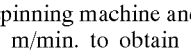

$$R_1ArSO_3X \quad [II]$$

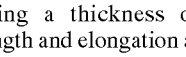

$$R_1O(R_2)_nArSO_3X \quad [III]$$

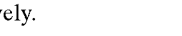

$$R_1OSO_3X \quad [IV]$$

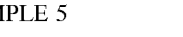

$$R_1O(R_2)_nSO_3X \quad [V]$$

(in the formula, $R_1$ represents a linear, branched or cyclo-hydrocarbon group having carbon atoms ranging from 6 to 20; X represents an alkaline metal, alkaline earth metal, ammonium or organic ammonium; Ar represents benzene nucleus; $R_2$ represents ethyleneoxide and/or propyleneoxide; and n represents an integer from 1 to 10.).

2. A polyurethaneurea elastic fiber according to claim 1, wherein X represents ammonium or organic ammonium.

* * * * *